US009505050B2

(12) United States Patent
Seeber

(10) Patent No.: US 9,505,050 B2
(45) Date of Patent: Nov. 29, 2016

(54) FORGING MACHINE

(71) Applicant: GFM—GmbH, Steyr (AT)

(72) Inventor: Alfred Seeber, Steyr (AT)

(73) Assignee: GFM GmbH, Steyr (AT)

( * ) Notice: Subject to any disclaimer, the term of this patent is extended or adjusted under 35 U.S.C. 154(b) by 0 days.

(21) Appl. No.: 14/953,830

(22) Filed: Nov. 30, 2015

(65) Prior Publication Data

US 2016/0151827 A1 Jun. 2, 2016

(30) Foreign Application Priority Data

Dec. 2, 2014 (AT) ..... A 50870/2014

(51) Int. Cl.

| | |
|---|---|
| ***B21J 13/10*** | (2006.01) |
| ***B21J 13/12*** | (2006.01) |
| ***B21D 43/10*** | (2006.01) |
| ***B21J 9/20*** | (2006.01) |

(52) U.S. Cl.

CPC ..... *B21J 13/12* (2013.01); *B21D 43/10* (2013.01); *B21J 9/20* (2013.01); *B21J 13/10* (2013.01)

(58) Field of Classification Search

CPC ..... B21J 13/12; B21J 13/10; B21J 9/20; B21D 43/10

USPC ..... 72/420

See application file for complete search history.

(56) References Cited

U.S. PATENT DOCUMENTS

| | | | | | |
|---|---|---|---|---|---|
| 3,447,349 | A * | 6/1969 | Lippke | B21J 9/20 | 72/20.1 |
| 3,468,154 | A * | 9/1969 | Hertl | B21J 13/10 | 72/421 |
| 3,557,601 | A * | 1/1971 | Schussler | B21J 13/10 | 72/420 |
| 3,590,616 | A * | 7/1971 | Schussler | B21J 13/10 | 72/20.2 |
| 3,611,770 | A | 10/1971 | Kralowetz | | |
| 3,712,096 | A | 1/1973 | Braunwieser et al. | | |
| 4,031,736 | A * | 6/1977 | Kutz | B21J 13/10 | 72/420 |
| 4,776,199 | A * | 10/1988 | Schubert | B21J 13/10 | 279/4.06 |
| 5,000,028 | A * | 3/1991 | Krieger | B21J 13/10 | 72/421 |
| 5,218,855 | A * | 6/1993 | Werner | B21J 13/10 | 72/420 |
| 7,204,120 | B2 * | 4/2007 | Koppensteiner | B21J 13/12 | 72/419 |
| 7,469,568 | B2 * | 12/2008 | Reissenweber | B21J 13/10 | 72/361 |
| 8,234,903 | B2 * | 8/2012 | Claasen | B21J 13/12 | 72/361 |
| 2005/0272543 | A1 | 12/2005 | Seeber | | |

FOREIGN PATENT DOCUMENTS

| | | |
|---|---|---|
| AT | 278 481 B | 2/1970 |
| AT | 290256 B | 5/1971 |
| AT | 396 883 B | 12/1993 |
| EP | 1 600 228 A1 | 11/2005 |

* cited by examiner

*Primary Examiner* — David B Jones

(74) *Attorney, Agent, or Firm* — Collard & Roe, P.C.

(57) ABSTRACT

A forging machine is described having at least one clamping head (6) for a work-piece (5) and having a rotational drive, which is controllable in dependence on the engagement of the forging tools (3), for the clamping head (6). To provide advantageous drive conditions, it is proposed that the rotational drive comprise at least one hydraulic motor (11), which is connected to a pump circuit (12), and which is connected to a hydraulic circuit (17), which is connected in parallel to the pump circuit (12), for the periodic supply and discharge of a predefined quantity of hydraulic medium in dependence on the stroke frequency and/or the stroke location of the forging tools (3).

6 Claims, 4 Drawing Sheets

FORGING MACHINE

CROSS REFERENCE TO RELATED APPLICATIONS

Applicant claims priority under 35 U.S.C. §119 of Austrian Application No. A50870/2014 filed on Dec. 2, 2014, the disclosure of which is incorporated by reference.

FIELD OF THE INVENTION

The invention relates to a forging machine having at least one clamping head for a workpiece and having a rotational drive, which is controllable in dependence on the engagement of the forging tools, for a spindle of the clamping head.

DESCRIPTION OF THE PRIOR ART

In round forging, the workpiece, which is held via a clamping head and driven with the aid of a spindle, is fixed in a rotationally-fixed manner by the forging tools during the engagement of the forging tools. To avoid torsion stresses of the workpiece which are thus caused, driving the spindle via a worm gear, the worm of which, which is mounted so it is axially displaceable, is supported axially on a spring mechanism, is known (AT 278 481 B). A rotationally-oscillating drive by the worm gear can thus be superimposed on the continuous rotational drive of the worm, if the worm is axially displaced when the workpiece is fixed by the forging tools. The spring mechanism which is tensioned in this case ensures an axial restoring movement of the worm as soon as the workpiece is released again. With appropriate tuning of the resonant behavior of the spring mechanism to the vibratory drive system, an intermittent drive of the spindle which is synchronous with the drive of the forging tools can therefore be achieved. To adapt the oscillation behavior to different forging conditions, replacing the mechanical spring mechanism with a hydraulic spring having a settable hydraulic volume, into which displacement bodies engaging on an oscillating drive part alternately plunge, is additionally known (AT 396 883 B).

In addition (EP 1 600 228 A1), providing a rotational drive in the form of a belt drive with a continuously drivable drive wheel and an output wheel connected to the spindle and coupling this rotational drive to a superposition drive, which has a carrier, which is displaceable in a rotationally oscillating manner about the axis of the output wheel, having two deflection rollers for the belt drive, has also been proposed. Due to a rotationally-oscillating drive of the carrier, the belt section alternately lengthens on the feed and discharge sides of the drive wheel, while the belt section on the respective opposing side shortens, so that the rotational movement of the output wheel thus caused is superimposed on the continuous rotational drive by the drive wheel. Notwithstanding the fact that the design expenditure of this known intermittent rotational drive for the clamping heads is substantial, these rotational drives are unsuitable for more recent forging methods, which require higher rotational accelerations and decelerations between the engagements of the forging tools as a result of greater rotational angles.

SUMMARY OF THE INVENTION

The invention is therefore based on the object of embodying a rotational drive for the spindle of a clamping head of a forging machine so that advantageous design conditions result with respect to an intermittent spindle drive and the mass forces to be taken into consideration in this case can be kept comparatively small.

Proceeding from a forging machine of the type described at the outset, the invention achieves the stated object in that the rotational drive comprises at least one hydraulic motor, which is connected to a pump circuit, and which is connected to a hydraulic circuit, which is connected in parallel to the pump circuit, for the periodic supply and discharge of a predefined quantity of hydraulic medium in dependence on the stroke frequency and/or the stroke location of the forging tools.

The use of a hydraulic motor, preferably a hydraulic radial piston motor, which develops high torques at low speeds, represents advantageous conditions for a simple, intermittent rotational drive of the spindle of a clamping head, because the mass forces to be taken into consideration can be kept small, on the one hand, and the possibility exists of connecting a separate hydraulic circuit in parallel to the pump circuit having a continuous hydraulic medium flow, on the other hand, via which the hydraulic medium stream impinging the hydraulic motor can be periodically changed in dependence on the stroke frequency or also on the stroke location of the forging tools, in that a predefined quantity of hydraulic medium is supplied to and discharged from the hydraulic medium stream of the pump circuit, with the result that the hydraulic motor is periodically accelerated and decelerated in dependence on the supplied and discharged hydraulic medium quantity, so that with appropriate tuning of the hydraulic medium quantities supplied and discharged via the hydraulic circuit to the hydraulic medium throughput predefined by the pump circuit, the spindle of the clamping head can be driven intermittently. If the hydraulic medium quantity discharged by the hydraulic circuit corresponds to the quantity of hydraulic medium supplied by the pump circuit, the hydraulic motor is thus stationary. During the standstill, the engagement of the forging tools can advantageously occur. However, if the hydraulic motor is first stopped after the tool engagement or accelerated again during the tool engagement, torsion stresses are thus built up in the workpiece, which can be used if needed to influence the crystalline structure of the workpiece.

Particularly simple design conditions result if the hydraulic circuit has a piston-cylinder unit, the piston of which is drivable back and forth via a positioning drive, wherein the pressure chambers on both sides of the piston are connected to the hydraulic motor, so that the piston travel in the pressure chambers determines the hydraulic medium quantity of the hydraulic circuit which is supplied on one side and discharged on the other side. The hydraulic medium throughput of the hydraulic motor can therefore be controlled, via the positioning drive for the piston of the piston-cylinder unit of the hydraulic circuit in the meaning of the desired intermittent rotational drive of the spindle of the clamping head, by a comparatively small servo valve.

To keep the mass forces to be taken into consideration with respect to the spindle drive small, the positioning drive can comprise at least one positioning cylinder, which can be impinged on both sides via a switching valve. However, two positioning cylinders which can be impinged in opposite directions can also be provided for this purpose. Via the control of the positioning drive for the piston of the piston-cylinder unit, the hydraulic motor per se can be activated arbitrarily with respect to the time curve of the rotational angle, which is dependent on the throughput of the hydraulic medium, so that in the case of a control of the positioning drive dependent on the tool engagement, advantageous adaptation possibilities to different forging conditions result.

Of course, the positioning drive can also be coupled to a spring mechanism to save energy, so that an oscillating system results, which can be excited by the positioning drive in dependence on the stroke frequency of the forging tools. To be able to take different resonant frequencies into consideration in a simple manner, the spring mechanism can be designed as a hydraulic spring mechanism, the resonance behavior of which can be influenced via the definitive volume of the hydraulic medium.

To be able to exert special tensions inside the workpiece to influence the crystalline structure, on the surface profile during the forging of workpieces which are rectangular or square in cross-section, or on the torsion of a workpiece during the tool engagement, the forging machine can have two clamping heads with rotational drives in the form of hydraulic motors, the hydraulic circuits of which, which are separate from the pump circuits, are controllable in dependence on one another, so that via different rotational angles of the spindles of the clamping heads, different torsion stresses are built up inside the workpiece and can also be maintained during the forging procedure.

BRIEF DESCRIPTION OF THE DRAWING

The subject matter of the invention is illustrated as an example in the drawing. In the FIGS.

DESCRIPTION OF THE PREFERRED EMBODIMENT

Figure 1:
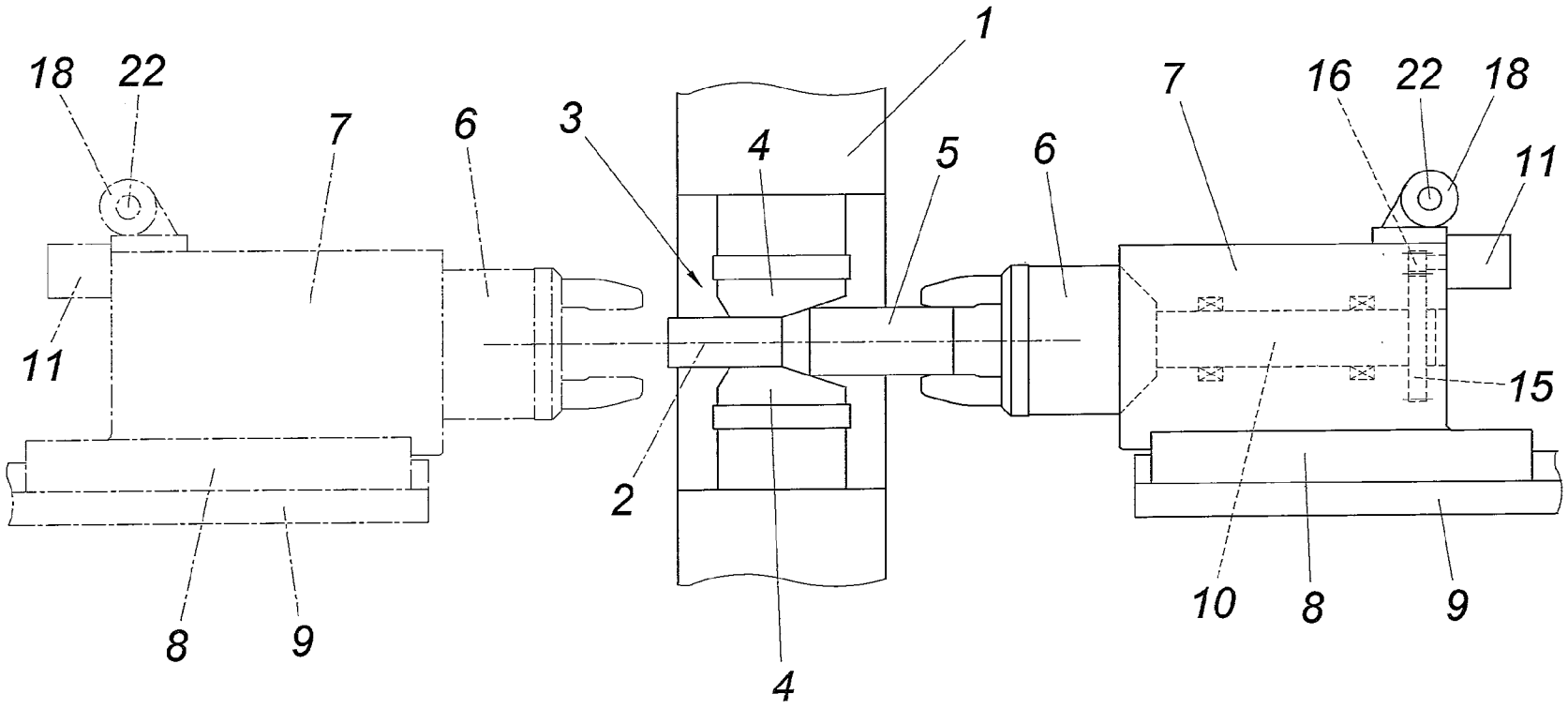
FIG. 1 shows a forging machine according to the invention in a schematic side view.

The forging machine has, according to FIG. 1, in a conventional manner, a frame 1 having four forging tools 3, which are opposite to one another in pairs with respect to a forging axis 2, and which are impinged via positioning drives radially in relation to the forging axis 2 and are equipped with forging hammers 4. The positioning drives for the forging tools 3 arranged in pairs can be actuated in this case, depending on the selected forging method for the tool pair, simultaneously or in succession at a time interval, so that the workpiece 5 is machined simultaneously or in sections by the forging tools 3 distributed around its circumference. The workpiece 5 is grasped on the end with the aid of at least one clamping head 6 and rotated about the forging axis 2. The clamping head 6 itself is mounted in a housing 7, which is movable with the aid of a carriage 8 along a guide 9.

The clamping head 6 mounted in the housing 7 is driven via a spindle 10. The rotational drive provided for this purpose comprises at least one hydraulic motor 11, which is insensitive to pressure surges, and which can preferably be embodied as a hydraulic radial piston motor, but also as an axial piston motor under certain circumstances. This hydraulic motor 11 is continuously impinged with a hydraulic medium stream via a pump circuit 12 according to FIG. 2. The hydraulic pump 13 of the pump circuit 12 is driven by a motor 14. The drive connection between the hydraulic motor 11 and the spindle 10 is produced in a simple manner via a gearwheel transmission, which comprises a gearwheel 15 seated on the spindle 10 and a pinion 16, which meshes with the gearwheel 15 and is driven by the hydraulic motor 11. As can be inferred from FIG. 2, the option also exists of driving the gearwheel 15 via two pinions 16, which are each connected to a hydraulic motor 11, which enables hydraulic tensioning of the pinions 16, which mesh with the gearwheel 15, via the hydraulic motors 11, which are driven synchronously because they are connected in series and enables a small structural size in comparison to a single drive.

To be able to drive the spindle 10 for the clamping head 6 intermittently in accordance with the forging conditions, the hydraulic motor 11 is connected, in parallel to the pump circuit 12, to a separate hydraulic circuit 17, via which predefined hydraulic medium quantities can be supplied and discharged, so that the continuous hydraulic medium stream predefined by the pump circuit is enlarged or reduced by the hydraulic medium stream of the hydraulic circuit 17 and therefore the hydraulic motor 11 is accordingly accelerated or decelerated.

Figure 2:
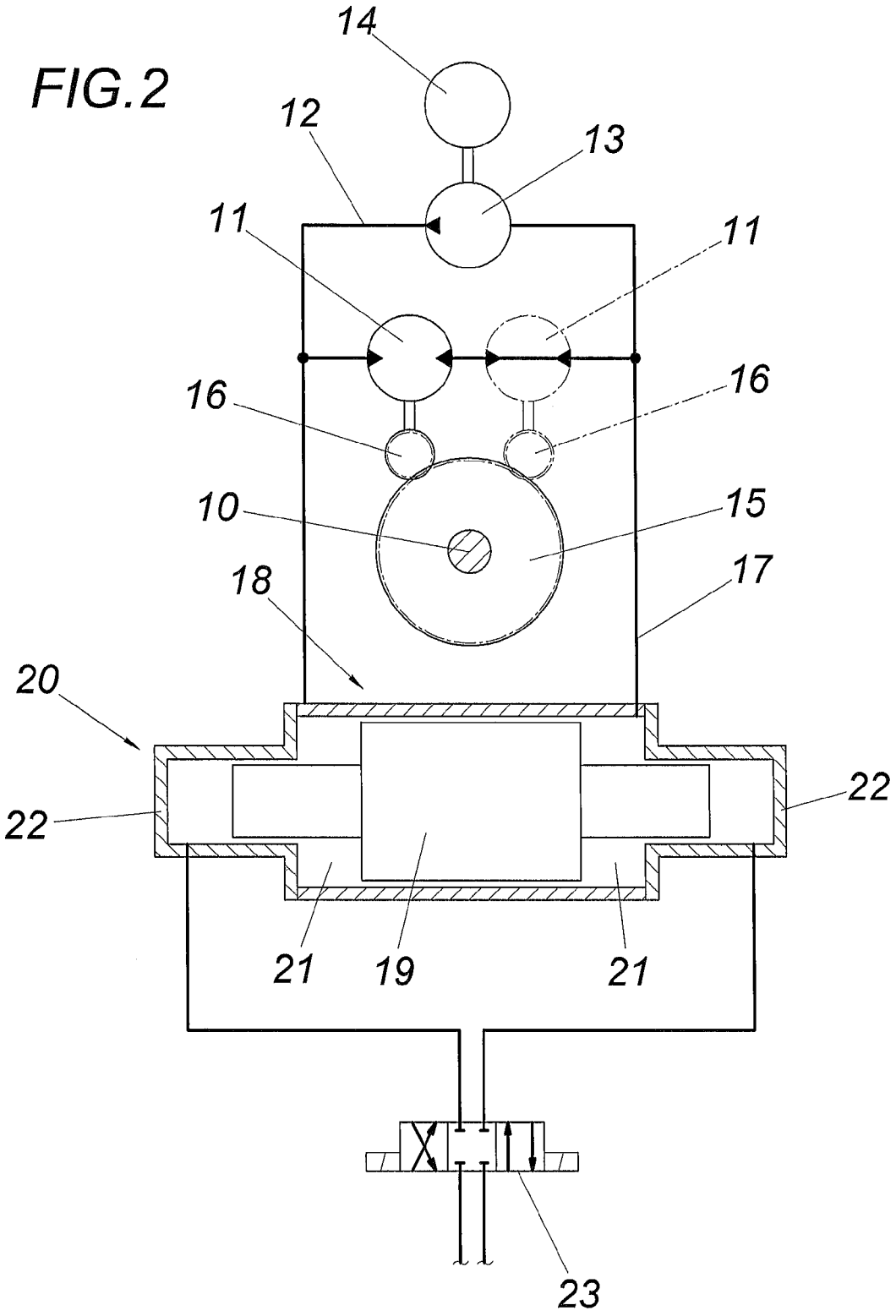
FIG. 2 shows a rotational drive for the spindle of a clamping head of the forging machine in a simplified block diagram.

According to FIG. 2, a piston-cylinder unit 18 is provided for this purpose in the hydraulic circuit 17, the piston 19 of which can be driven back-and-forth via a positioning drive 20. Since the pressure chambers 21 on the two piston sides are connected to the hydraulic motor 11, a displacement of the piston 19 in one direction causes hydraulic medium to be displaced from one of the two pressure chambers 21 and to be sucked in via the other pressure chamber 21 with the effect that the hydraulic medium quantity from the piston-cylinder unit 18 is supplied and discharged to and from the continuous hydraulic medium stream of the pump circuit 12. If the hydraulic medium quantity which is supplied and discharged corresponds to the hydraulic medium rate of the pump circuit 12, the hydraulic motor 11 is thus periodically accelerated and, after a corresponding acceleration, decelerated to a standstill. The positioning drive 20 for the piston 19 is therefore to be activated periodically in dependence on the stroke frequency of the forging tools 3. In addition, the control can also be made dependent on the stroke location of the forging tools 3.

The positioning drive 20 is formed, according to FIG. 2, by two positioning cylinders 22 which can be impinged in opposite directions, and which are impinged accordingly via a control valve 23. The positioning movement of the piston 19 can therefore be adapted to the respective requirements via the activation of the control valve 23.

Figure 3:
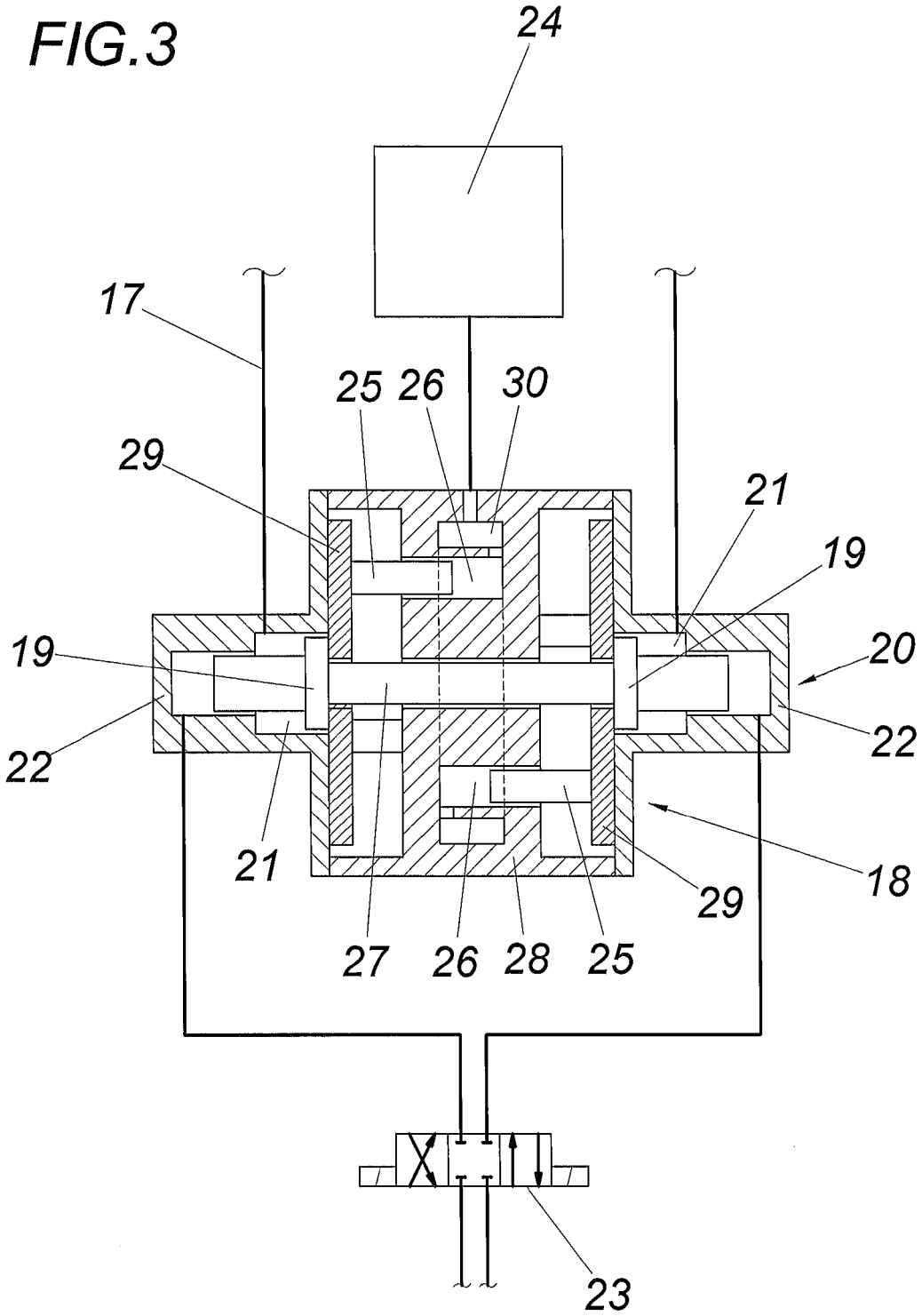
FIG. 3 shows a piston-cylinder unit, which is altered in relation to the embodiment according to FIG. 2, for the hydraulic circuit in a block diagram.

The piston-cylinder unit 18 according to FIG. 3 differs from that according to FIG. 2 essentially only in that this piston-cylinder unit 18 is coupled to a hydraulic spring mechanism 24, so that the piston 19 can be operated in an energy-saving manner as part of an oscillating system. For this purpose, displacement bodies 25 are associated with the divided piston 19, which engage in boreholes 26 of a housing 28, which is penetrated by the piston rod 27 between the two partial pistons 19. These displacement bodies 25, which are distributed about the piston rod 27, are supported axially on pressure plates 29, which are each carried along in one direction by the partial piston 19. Since the boreholes 26 are connected via a ring chamber 30 to the hydraulic spring mechanism 24, the back-and-forth piston displacement causes an alternating impingement of the hydraulic spring mechanism 24 by the displacement bodies 25 associated with the two piston sides.

Figure 4:
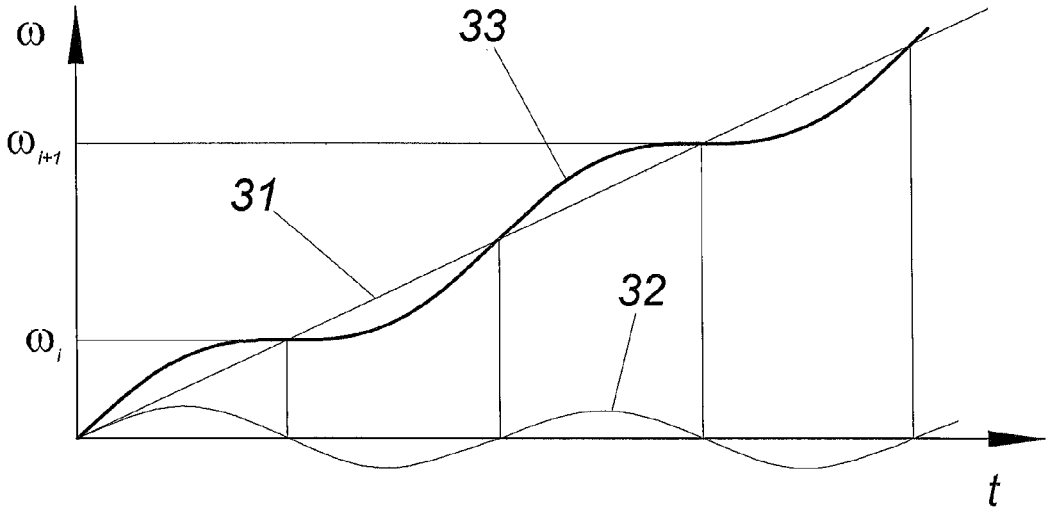
FIG. 4 shows a characteristic curve illustrating a possible time curve of the rotational angle of the radial piston motor.
Figure 5:
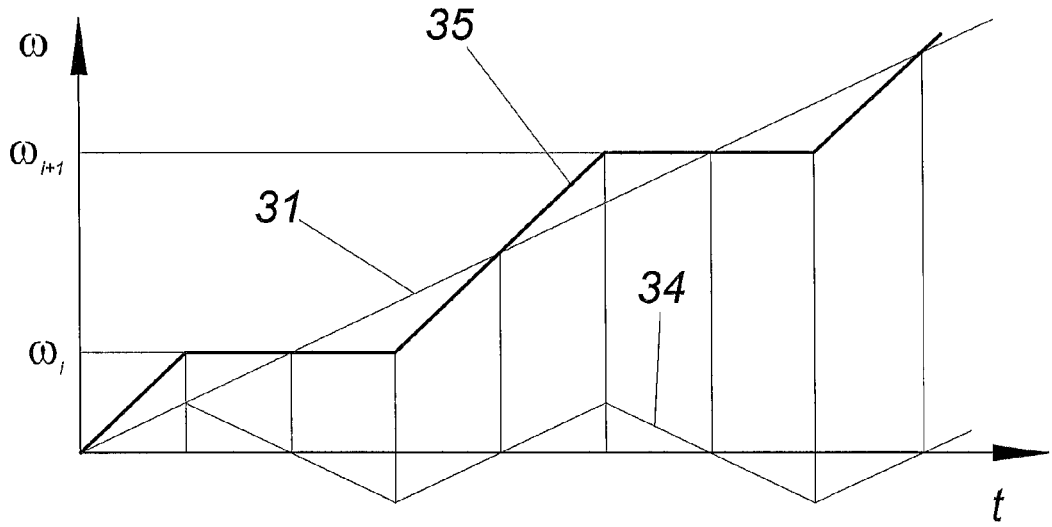
FIG. 5 shows an illustration corresponding to FIG. 3 of a characteristic curve for a different rotational angle time curve.

The time curve of the rotational angle ω of the hydraulic motor 11 is shown in FIG. 4. The characteristic curve 31 shows the time curve of the rotational angle ω for the case that the hydraulic circuit 17 is shut down by blocking the control valve 23 and therefore the hydraulic motor 11 is only impinged by the continuous hydraulic medium stream of the pump circuit 12. With hydraulic pump 13 shut down and an impingement of the hydraulic motor 11 via a piston-cylinder unit 18 according to FIG. 3, a sinusoidal curve of the hydraulic medium flow in the hydraulic circuit 17 results, which results in a sinusoidal curve of the rotational angle ω according to the characteristic curve 32 of FIG. 3. With a superposition of the hydraulic medium streams of the pump circuit 12 and the hydraulic circuit 17, a rotational angle curve corresponding to the characteristic curve 33 results for the hydraulic motor 11. With corresponding adaptation of the hydraulic medium quantities, a periodic standstill of the hydraulic motor 11 can therefore be achieved in a simple manner, as can be inferred from the curve of the rotational angle ω corresponding to the characteristic curve 33, specifically at the rotational angles $\omega_i$ and $\omega_{i+1}$.

The time curve of the rotational angle ω is thus dependent on the size and the speed curve of the hydraulic medium quantity supplied and discharged via the hydraulic circuit 17. This means that in the case of a linear increase of the supplied and discharged hydraulic medium quantity, a rotational angle curve which changes linearly between a highest value and a lowest value results corresponding to the characteristic curve 34 of FIG. 4 as a result of impingement of the hydraulic motor 11 solely via the hydraulic circuit 17. A superposition of the pump circuit 12 with a rotational angle curve corresponding to the characteristic curve 31 and a hydraulic circuit 17 controlled in this manner therefore causes a rotational angle curve according to the characteristic curve 35 having particularly pronounced standstill times at the rotational angles $\omega_i$ and $\omega_{i+1}$. By way of a corresponding selection of the size and the speed of the hydraulic medium quantity inside the hydraulic circuit 17, influence may therefore be taken in broad limits on the chronological rotational angle curve of the hydraulic motor 11 and therefore of the clamping head 6 of a forging machine.

As a result of the control according to the invention of the rotational drive for the clamping head 6, influence can additionally be taken on the microstructure arising during forging, if the forging machine is equipped with two clamping heads 6 according to the invention, as indicated by the dot-dash lines in FIG. 1. Specifically, the workpiece 5 can be subjected to torsion stresses between the clamping heads 6, which influence the microstructure of the workpiece 5 during forging, as a result of the controllable rotational angle ω of the clamping heads 6.

The invention claimed is:

1. A forging machine comprising:

(a) at least one clamping head for a workpiece;

(b) a plurality of forging tools; and (c) a rotational drive for the clamping head controllable in dependence on engagement of the forging tools;

wherein the rotational drive comprises a pump circuit, a hydraulic circuit connected to the pump circuit, and at least one hydraulic motor connected to the pump circuit and to the hydraulic circuit;

wherein the hydraulic motor periodically supplies and discharges a predefined quantity of hydraulic medium; and wherein the predefined quantity of hydraulic medium is periodically supplied or discharged in dependence on at least one of stroke frequency and stroke location of the forging tools.

2. The forging machine according to claim 1, wherein the hydraulic circuit comprises a piston-cylinder unit comprising a piston drivable back and forth via a positioning drive and pressure chambers on both sides of the piston connected to the hydraulic motor.

3. The forging machine according to claim 2, wherein the positioning drive comprises at least one positioning cylinder.

4. The forging machine according to claim 2, wherein the positioning drive is coupled to a spring mechanism.

5. The forging machine according to claim 4, wherein the spring mechanism is designed as hydraulic spring mechanism.

6. The forging machine according to claim 1, wherein two clamping heads having rotational drives in the form of hydraulic motors comprising pump circuits and hydraulic circuits are provided, wherein the hydraulic circuits are separate from the pump circuits and controllable independently of one another.

* * * * *